United States Patent [19]

Davis

[11] Patent Number: 4,468,940

[45] Date of Patent: Sep. 4, 1984

[54] LOCK BOX

[76] Inventor: Richard W. Davis, 2107 E. Aspen, Tempe, Ariz. 85282

[21] Appl. No.: 305,992

[22] Filed: Sep. 28, 1981

[51] Int. Cl.[3] ..... B65D 55/14; E05B 65/52

[52] U.S. Cl. ..... 70/63

[58] Field of Search ..... 70/63, 158–173, 70/139

[56] References Cited

U.S. PATENT DOCUMENTS 1,271,096 7/1918 Stewart et al. ..... 70/158

3,709,538 1/1973 Seitz ..... 292/DIG. 38

4,325,239 4/1982 Larson ..... 70/139

FOREIGN PATENT DOCUMENTS 2306424 10/1973 Fed. Rep. of Germany ..... 70/63

*Primary Examiner*—Robert L. Wolfe

*Attorney, Agent, or Firm*—Cahill, Sutton & Thomas

[57] ABSTRACT

A hingedly attached face plate shieldingly protects a key deposited within a key storage compartment in the lock box. Variants of the lock box accommodate conventional cam locks or shielded padlocks for locking the face plate in place. The lock box is attached to a mounting surface by normally inaccessible fasteners.

25 Claims, 13 Drawing Figures

LOCK BOX

The present invention relates to lock boxes and, more particularly, to lock boxes for retaining keys.

Lock boxes for keys are usually utilized when one or a number of individuals have a need for access to a number of key locked compartments or the like. When so used, the key to the compartment is locked within the lock box and all of the lock boxes are accessible with a common key. Thereby, a single key can provide access to a large number of differently locked compartments. Moreover, should control over a master key to the lock boxes be lost, it is a simple and relatively inexpensive matter to change the locks in the lock boxes.

Over the years, a number of lock devices have been developed for use in the above described environment and for related purposes. U.S. Pat. No. 4,113,291 describes and illustrates a lock system having a hingedly attached cover for shielding an operating shaft; the cover is lockable in place with a padlock. U.S. Pat. Nos. 3,477,261, 4,070,882 and 4,227,388 describe various lock boxes having movable cover members for concealing a lock from view and otherwise rendering it inaccessible. U.S. Pat. Nos. 1,004,758 and 2,883,849 disclose lockable cover members for limiting access to a lock related element A lock box for storing a house key and commonly used by real estate agents has a bent flange for engaging the top edge of a door, which flange, in combination with door jam, precludes removal of the lock box when the door is closed.

The present invention is directed to a lock box having a pivotally supported face plate, which face plate shields a key deposited directly on its interior surface or on a platform within the box. The face plate is lockingly engaged by a key operated cam lock, padlock or other lock. The face plate, as well as other elements used in variants, are cross-sectionally configured to accommodate a plurality of functions whereby the parts count of the lock box can be maintained as low as three, depending upon complexity and various functions to be accommodated. Moreover, the elements are configured to be manufactured by extrusion processes and thereby substantial savings can be effected. The lock box is attached to a mounting surface by fasteners extending outwardly from the shielded rear face of the lock box.

It is therefore a primary object of the present invention to provide a lock box having the capability of being locked by more than one type of lock.

Another object of the present invention is to provide a hinged lockingly secured face plate for shielding within a lock box a locked item.

Still another object of the present invention is to provide an inexpensive and robust lock box.

Yet another object of the present invention is to provide a face plate configuration for a lock box which is adaptable to various box locking devices.

A further object of the present invention is to provide a lock box which shields the shackle of an employed padlock.

A still further object of the present invention is to provide a lock box having elements variably positionable with respect to one another for accommodating different locking devices.

A yet further object of the present invention is to provide an inexpensive universally useable lock box.

A yet further object of the present invention is to provide a lock box assembleable from extruded elements.

These and other objects of the present invention will become apparent to those skilled in the art as the description thereof proceeds.

The present invention may be described with greater specificity and clarity with reference to the following drawings, in which:

FIG. 6 is a perspective view of a further variant of the lock box;

Figure 9A:
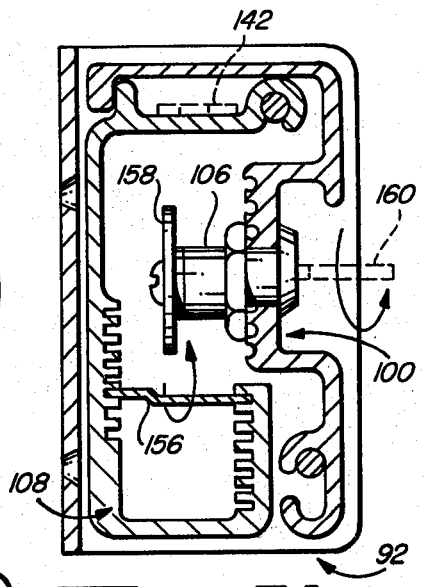
Figure 9B:
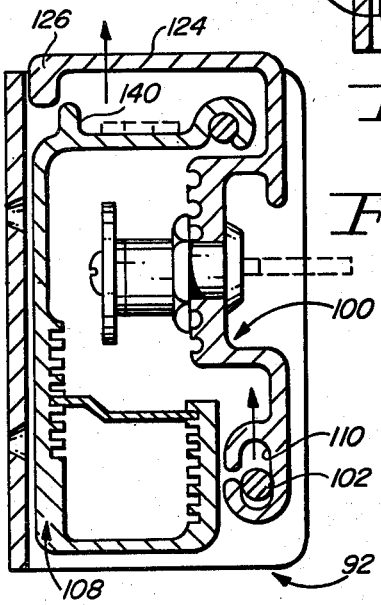
Figure 10:
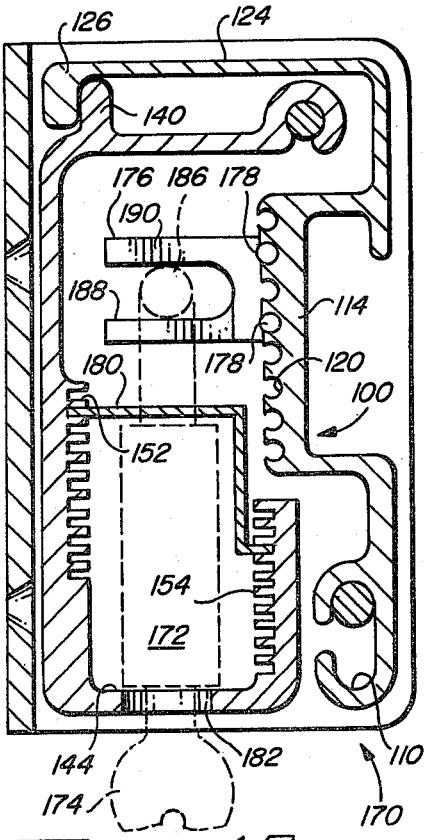
Figure 9C:
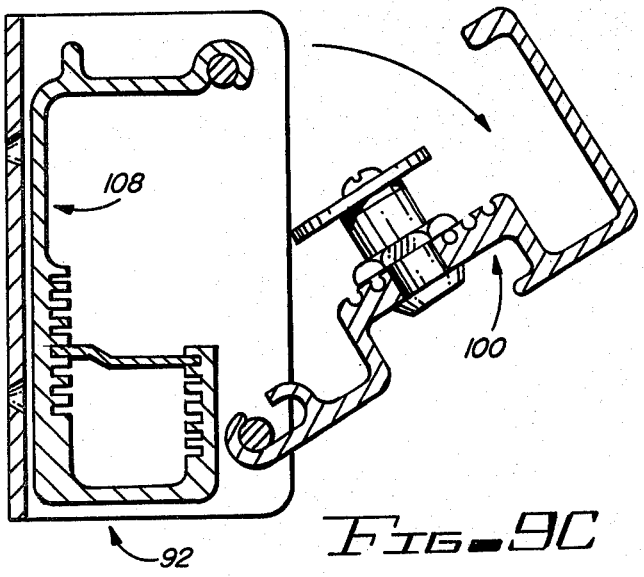
Figure 11:
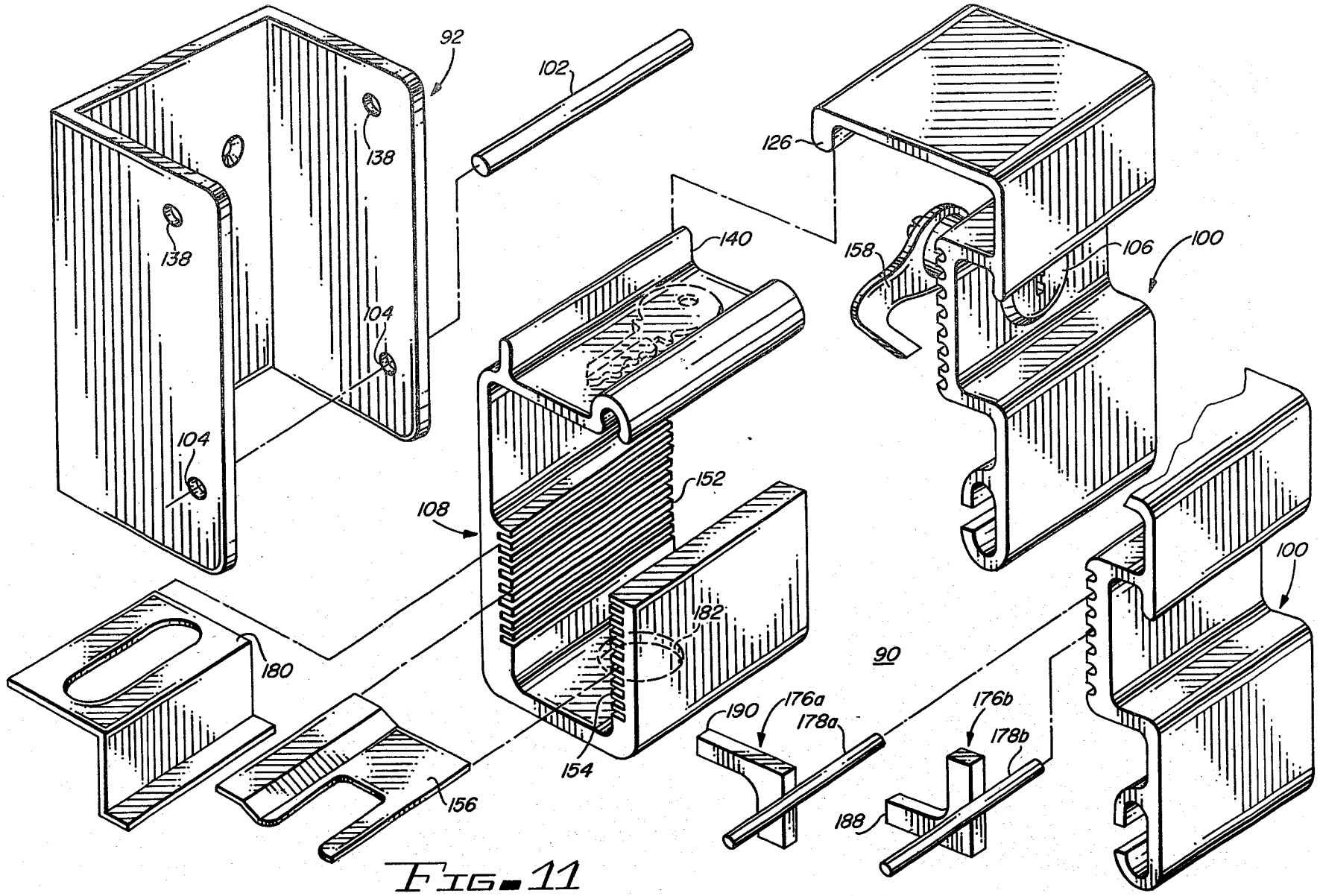

FIGS. 9*a*, 9*b* and 9*c* illustrate operation of the lock box shown in FIG. 6;

FIG. 10 illustrates an adaptation of the lock box shown in FIG. 6 for use with a padlock; and FIG. 11 is an exploded isometric view of the lock boxes shown in FIGS. 6 and 10.

Figure 1:
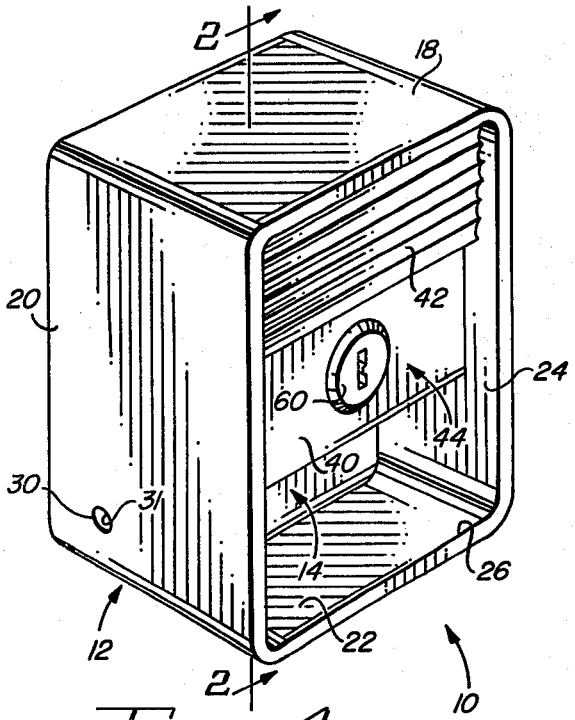
FIG. 1 is a perspective view of a lock box having a cam lock.
Figure 2:
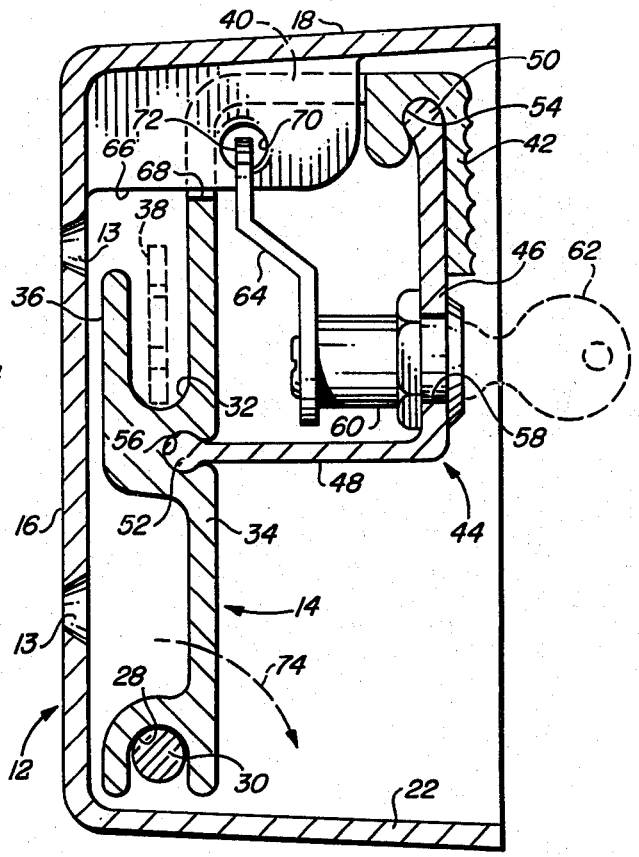
FIG. 2 is a cross-sectional view taken along lines 2—2, as shown in FIG. 1.

Referring jointly to FIGS. 1 and 2, there is shown a lock box 10 formed by a box 12 and a face plate 14. The box includes a base 16 from which extend side walls 18, 20, 22 and 24. The base and side walls are developed as a unitary structure by well known manufacturing/fabrication techniques for metals, such as aluminum. The three edges of the side walls define an opening 26. Face plate 14 is nested within box 12 and is dimensioned in width and length for close but nonbinding conformance with the corresponding interior side wall surfaces.

Face plate 14 is pivotally mounted within box 12 by having a downwardly opening channel 28 formed integral therewith for pivotal engagement with a rod 30 supported by and disposed in apertures 31 in side walls 20, 24. A trough 32 is developed intermediate face member 34 of the face plate and an upwardly extending ridge 36 rearward of the face member. The trough is dimensioned to support the element to be locked within lock box 10, such as key 38 depicted in phantom lines. Face member 34 includes a forwardly extending plate 40 and a face plate 42 depending downwardly from the forward extremity of plate 40.

A right angle bracket 44 includes flanges 46, 48 having laterally expanded bulbous edges 50, 52, respectively. The bulbous edges interlockingly engage with commensurately formed undercut grooves 54, 56 formed at the junction of plate 40 and face plate 42 and within face member 34. Engagement/disengagement between face plate 14 and bracket 44 may be effected by sliding one with respect to the other along an axis commensurate with bulbous edges 50, 52 (see FIG. 5). Additional structure support for the bracket is provided by face plate 42 extending downwardly and juxtaposed with the corresponding surface of flange 46.

Flange 46 includes an aperture 58 wherein a conventional commercially available key operated cam lock 60 is mounted. Turning of key 62 (shown in phantom)

results in commensurate angular rotation of an attached latch 64. A downwardly depending flange 66 is supported by side wall 18 and base 16; preferably, the flange is located at the mid point of the side wall. A slot 68 is formed in face member 32 and plate 40 to accommodate penetration therethrough of flange 66 on positioning of face plate 14 into the locked position. The flange includes an aperture 70 disposed in close proximity to the forward face of face member 34 when the face plate is in the lock position. Latch 64 includes a prong 72 or the like for penetrable engagement with aperture 70 in flange 66; thereby, engagement/disengagement of the prong with the aperture is a function of rotation of key 62.

In operation, rotation of key 62 to disengage prong 72 of latch 64 with aperture 70 removes constraint against forward pivotal movement of face plate 14 about rod 30. Such pivotal movement may be continued, as depicted by arrow 74 until key 38, disposed in trough 32, may be removed. To relock key 38 within lock box 10, it is placed within trough 32 and face plate 14 is rotated about rod 30 to seat the face plate within the box in the position shown in FIG. 2. Actuation of the cam lock by key 62 will cause latch 64 to rotate and bring about engagement of prong 72 with aperture 70. Key 62 may now be withdrawn. Outward rotation of face plate 14 is precluded by the interference which will result between face member 34 of face plate 14 and latch 64 retained in place by the prong's penetrable engagement with aperture 70. Thereafter, key 62 may be removed.

Figure 3:
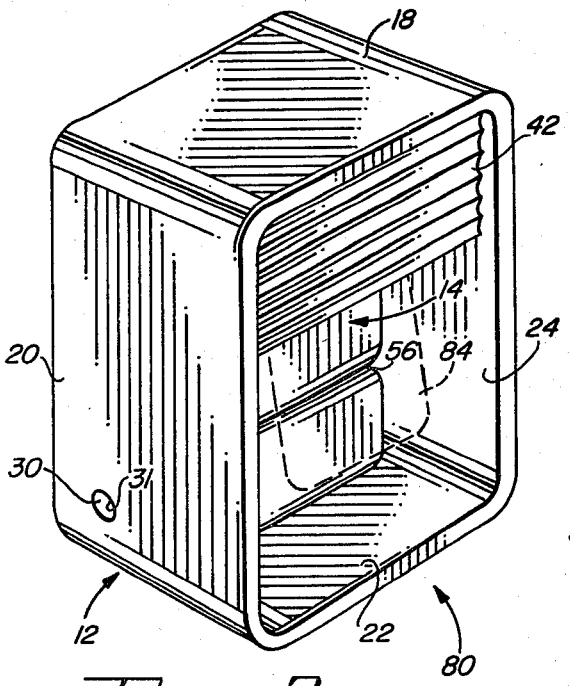
FIG. 3 is a perspective view of a variant lock box for supporting a padlock.
Figure 4:
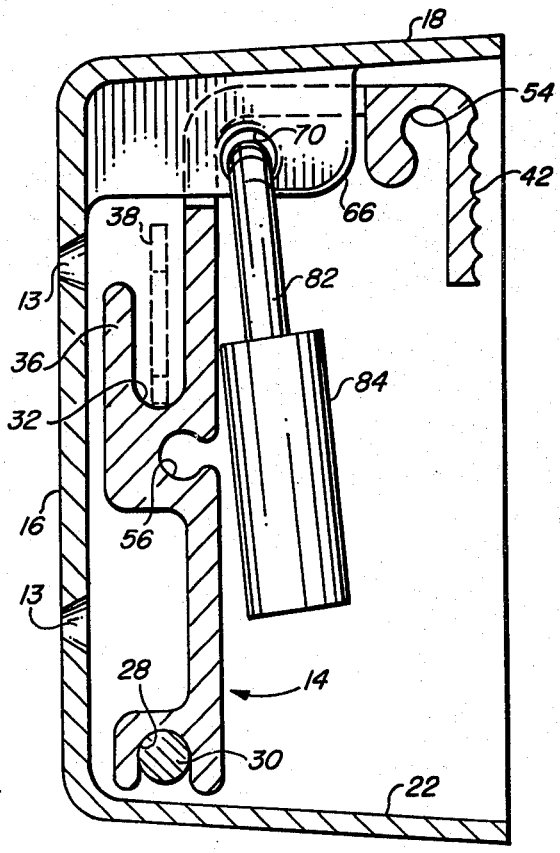
FIG. 4 is a cross-sectional view of the lock box shown in FIG. 3.
Figure 9:
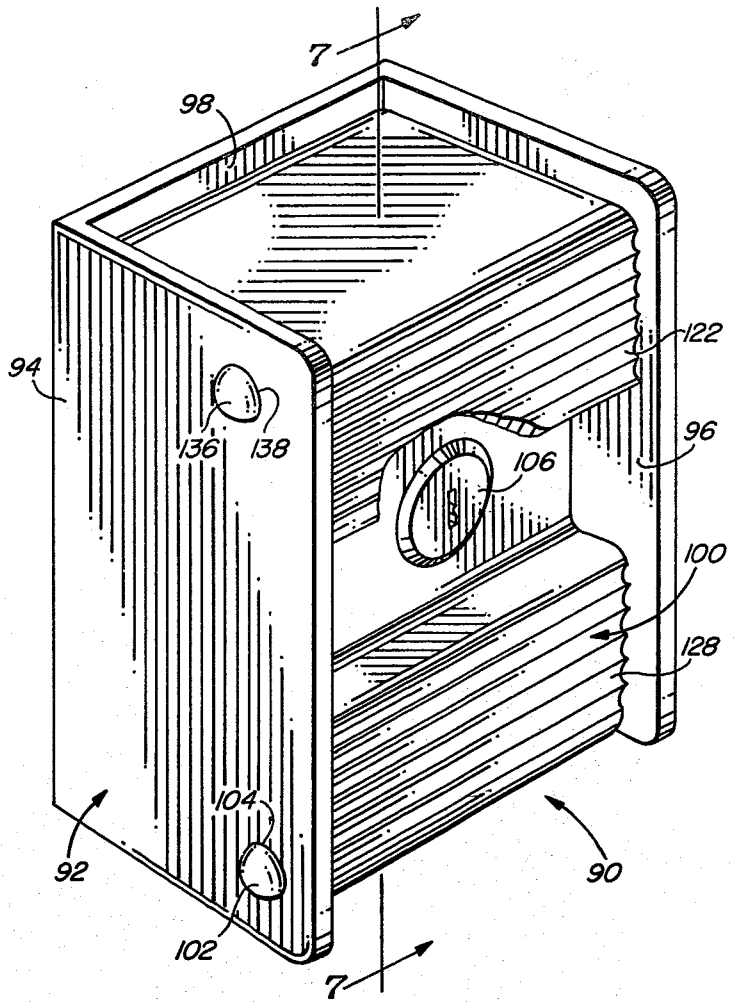
Figure 5:
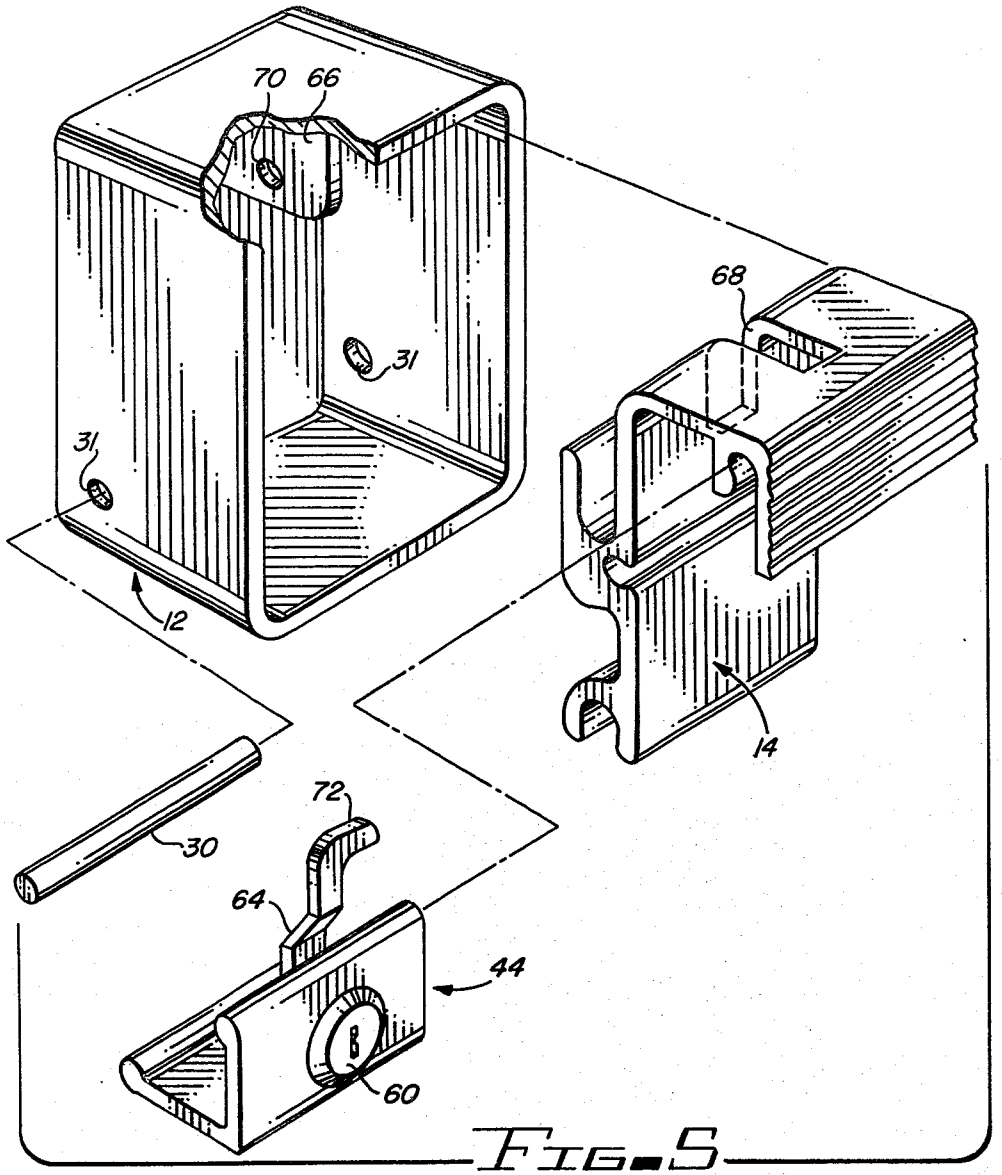
FIG. 5 is an exploded isometric view of the lock box shown in FIGS. 1 and 3.

Referring to FIGS. 3, 4 and 5, a variant 80 of the lock box is shown. All of the components herein are identical to those described with respect to lock box 10 with one exception. Herein, bracket 44 is not employed. Face plate 14 is identical to that shown in FIGS. 1 and 2 and therefore it will have formed therein grooves 54 and 56 which are operatively unused. Locking of lock box 80 is achieved by means of shackle 82 of padlock 84 penetrably engaging aperture 70 of flange 66. When in place, the shackle will preclude forward pivotal movement of face plate 14 due to interference therewith. The shrouding effect of the combination of side walls 18, 20, 22, 24 and front plate 42 renders it very difficult to apply any kind of cutting, grinding, or sawing tools to shackle 82 to obtain severance thereof and permit removal of the padlock.

Referring to FIG. 5, the three major components of the lock box, box 12, face plate 14 and pin 30 are shown in an exploded view to illustrate the facile method of assembly thereof. Additionally, the means for lockingly engaging bracket 44 with the face plate is also shown. From FIG. 5 it will become evident that face plate 14 may be formed from a specially configured extrusion of aluminum or the like. Bracket 44 may be similarly formed. Thereafter, the formed extrusion is cut to produce face plates and brackets of appropriate width to nestingly mate with box 12. Similarly, rod 80 may be cut from an extended length rod of appropriate diameter. The rod is maintained in place in lock box 12 by any number of well known means, such as deforming the junction intermediate supporting apertures 31, etc. Box 12 may be formed by various fabrication techniques well known in the aluminum and metal working industry.

As particularly illustrated in FIGS. 1, 3 and 5, front plate 42, in combination with the visible part of face plate 14, with or without bracket 44 in place, may be left planar or surfaced with ornamental designs, depending upon the aesthetic considerations desired.

Attachement of box 12 to a mounting surface may be by means of fasteners (not shown) extending through apertures 13 disposed in base 12 (see FIGS. 2 and 4). The heads of these fasteners will be shielded by face plate 14 to prevent access to the fasteners and dismounting of the lock box by undoing the fasteners.

FIGS. 6 through 11 illustrate a second variant 90 of the lock box. This variant includes three primary elements, each of which may be an extruded aluminum form and two secondary elements which may be segments of an aluminum rod. A channel shaped frame 92 includes side walls 94, 96 extending from a base 98. Frame 92 is attached to a mounting surface by fastener means, such as countersunk screws or bolts, extending through apertures 99 disposed in base 98 of frame 92. A face plate 100 is disposed intermediate side walls 92 and 96 in close conformance therewith but with sufficient freedom to accommodate pivotal movement of the face plate into and out of registration with the side walls. The pivot mechanism for the face plate includes a rod 102 supported within aperture 104 in each of side walls 92 and 96. Means for locking the face plate in place may be effected by a conventional cam lock 106 or a padlock 172; the latter will be described in greater detail below. As illustrated in FIG. 6, face plate 100 may include ornamentation disposed directly thereon, such as the scalloped surfaces indicated.

Figure 7:
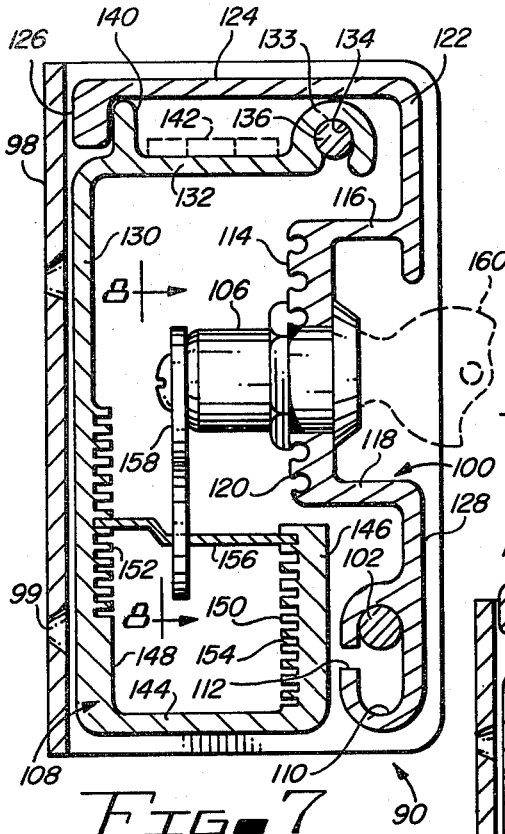
FIG. 7 is a cross-sectional view taken along lines 7—7, as shown in FIG. 6.

Referring specifically to FIG. 7, the configurations of face plate 100 and back plate 108 will be described. A transverse vertically elongated cavity 110 is developed at the lower front edge of the face plate. The cavity may be slotted longitudinally with slot 112, as indicated. The width of the cavity is commensurate with the diameter of rod 102 and the latter is retained therein. Central transverse section 114 of the face plate is offset inwardly by inwardly extending walls 116, 118. Section 114 may be of greater thickness than the remaining parts of the face plate in order to provide a robust mounting for cam lock 106 and to accommodate channels 120. Front plate 122 extends upwardly from wall 116 and supports a horizontal plate 124 extending toward base 98. The rear edge of plate 124 includes a downwardly depending lip 126. Front plate 122 and front plate 128 may include ornamentation, as shown in FIG. 6.

Back plate 108 includes a rear wall 130 supporting a forwardly extending shelf 132. The front edge of 133 of the shelf includes an undercut groove 134 for receiving and pivotally engaging rod 136, which rod is supporting within apertures 138 disposed in side walls 94, 96 of frame 92. A flange 140, displaced rearwardly from edge 133 defines a space in which key 142 in phantom lines to be locked within lock box 90 is deposited. A bottom plate 144 extends forwardly of rear wall 130 and its forward edge supports an upwardly extending front wall 146. Each of opposing surface 148, 150 includes a plurality of stacked slots 152, 154, the two stacks of slots being vertically offset with respect to one another, as illustrated. A retainer 156 is brought into sliding engagement with a slot of each stack of slots.

Figure 8:
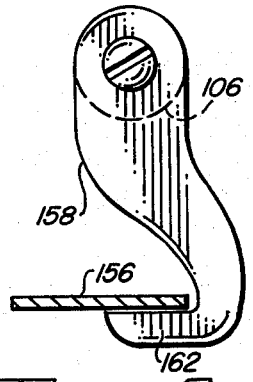
FIG. 8 is a side view taken along lines 8—8, as shown in FIG. 7.

Referring jointly to FIGS. 7 and 8, operation of cam lock 106 will be described. The cam lock includes a latch 158 openable in response to operation of the cam lock by key 160. The latch includes a lip 162 for engaging the undersurface of retainer 156 when the latch/cam lock is brought into the locked position. Rotation of the latch by operation of key 160 away from the retainer will result in unlocking of lock box 90.

Referring jointly to FIGS. *9a, 9b* and *9c*, the operation of lock box 80 will be described. To open the lock box and provide access to stored key 142, key 160 is inserted into cam lock 106 and turned to bring about disengagement of latch 158 with retainer 156. Such disengagement releases face plate 100 from mechanical interlock with back plate 108. To open the lock box, face plate 100 is raised vertically, as indicated in FIG. *9b*, which vertical displacement is accommodated by elongated cavity 110 within which rod 102 is disposed. Upon sufficient upward movement of the face plate with respect to back plate 108, lip 126 depending from plate 124 will become vertically displaced from flange 140. It may be noted that prior to such vertical displacement of the lip, forward tilting of the front plate would be precluded by interference between the lip and the adjacent flange. Subsequent rotation of face plate 100 about rod 102 is illustrated in FIG. *9c*. Such rotation uncovers shelf 132 and key 142 placed thereupon may be removed for use and later replaced or other items may be deposited thereupon for safekeeping.

To lock the lock box, face plate 100 is rotated counter-clockwise until lip 126 is positioned past flange 140 and may be brought into juxtaposed relationship therewith by forcing the face plate downwardly until rod 102 engages the upper extent of cavity 110. Locking is effected by turning key 160 until latch 158 engages retainer 156.

By incorporating a plurality of opposed stacks of slots 152, 154, retainer 156 may be located at any height within a range of vertical displacement to accommodate a particular latch length or for other reasons.

FIGS. 10 and 11 illustrate a variant 170 of the lock box shown in FIG. 6. Herein, a cam lock is not used. Instead, a conventional padlock 172 is employed to serve the function of locking the lock box. Additionally, with certain padlocks, partial opening of the lock box can be automatically effected by operation of the shackle in response to actuation of padlock key 174. A staple 176, which may be two "L" shaped brackets 176*a*, 176*b* shown in FIG. 11, is attached to the interior surface of section 114 by having a plurality of rails 178 (178*a*, 178*b*), formed as part of the staple or otherwise attached thereto, slidably inserted within and retained by undercut channels 120. By spacing channels 120 a predetermined and uniform distance apart from one another and commensurate with the spacing between rails 178, permits positioning of the staple (or width between the legs thereof) in any one of several vertical positions. Such latitude in vertical positioning of the staple permits a wide range of padlocks and padlock configurations to be used.

Retainer 180 slidably engages and is retained by stacks of slots 152, 154. The configuration of the retainer is adapted to be commensurate with the length of the padlock body resting upon the upper surface of bottom plate 144. Thereby, vertical repositioning of the padlock body is constrained or minimized. An aperture 182 is disposed within bottom plate 144 to permit access to the padlock body by key 184.

In operation, in the padlock lock position, the shackle receivingly engages leg 188 of stapel 176, which leg bears against the undersurface of the horizontal portion of the shackle. Thereby, upward movement of the staple and commensurate upward movement of face plate 100 is precluded and the face plate is retained in the position shown in FIG. 10 such that lip 126 is maintained in juxtaposed relationship with flange 140 and pivotal movement of the face plate is precluded. Conventional shackle padlocks have a spring loaded shackle. On unlocking, the shackle is extended from the padlock body to release one leg of the shackle from interfering relationship to the padlock body. In the present invention, this shackle repositioning feature is used with advantage. On unlocking of padlock 172, shackle 186 will spring upwardly. Such upward spring will exert a force upon leg 190 of staple 176 to force the staple upwardly along with face plate 100. The upward movement of the face plate will completely or partially vertically upwardly displace the face plate. If the displacement is insufficient to provide clearance between lip 126 and flange 140, additional manual raising of the face plate may be necessary in order to achieve the freedom to pivot the face plate forwardly. If the shackle is not spring loaded, manual raising may have to be employed.

On locking, the face plate is pivoted counter-clockwise (as illustrated in FIG. 10) which pivotal movement will cause staple 176 to engage shackle 186. Downward movement of face plate 110 will result in commensurate downward movement of the shackle and locking of the padlock will occur when the shackle is driven home.

Because of the multitude of differently shaped retainers 180 which may be employed, the multiplicity of vertical positions which the retainer may be placed in and the range of selective heights at which staple 176 may be located with respect to the face plate, lock box 170 can accommodate almost any of the many padlock sizes and configurations presently available in the marketplace. It may also be noted that the padlock is completely shielded within lock box 170 whereby any attempt to break into the lock box by cutting the shackle would be totally thwarted.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A lock box for retaining an element to be secured, said lock box comprising in combination:

(a) means for defining sides of an enclosure within which the element may be contained;

(b) a face plate operatively associated with said defining means for limiting access to the enclosure, said face plate including a trough for receiving the element and retaining the element within the space defined by said face plate and said defining means;

(c) means for pivotally attaching said face plate to said defining means to selectively open and close the enclosure;

(d) a flange depending from one of the sides of said defining means;

(e) an aperture developed within said face plate for penetrably receiving said flange on closure of said face plate; and (f) means associated with said flange for accommodating lock means to prevent withdrawal of said flange through said face plate and thereby lock said face plate with said defining means and prevent unauthorized access to the enclosure.

2. The lock box as set forth in claim 1 wherein said flange includes an aperture accessible external to said face plate on closure of said face plate for engagement by the lock means.

3. The lock box as set forth in claim 1 wherein said face plate includes means detachably attaching said face plate to said defining means an opening of said face plate.

4. The lock box as set forth in claim 3 including means for shielding the shackle of the padlock.

5. The lock box as set forth in claim 3 wherein said attaching means comprises a rod mounted in said defining means and a channel disposed in said face plate for receiving said rod.

6. The lock box as set forth in claim 5 wherein at least opposed sides of said face plate extending from said attaching means are disposed interior of said defining means on closure of said face plate.

7. The lock box as set forth in claim 6 wherein said receiving means includes a flange having an aperture disposed therein for penetrable engagement by the latch of the cam lock or the shackle of the padlock.

8. The lock box as set forth in claim 7 wherein said flange protrudes through said face plate to position said aperture outside of said face plate.

9. The lock box as set forth in claim 8 wherein said lock box comprises three monolithic elements.

10. The lock box as set forth in claim 7 including a bracket slidably engageable with said face plate for supporting and shielding the cam lock.

11. The lock box as set forth in claim 10 wherein said lock box comprises four monolithic elements.

12. The lock box as set forth in claim 1 wherein said defining means comprises a channel member, a back plate and further means for pivotally attaching said back plate to said channel member.

13. The lock box as set forth in claim 12 wherein said pivotal attaching means interconnects said face plate with said channel member.

14. The lock box as set forth in claim 13 wherein said pivotal attaching means comprises a rod secured to said channel member and an elongated slot in said face plate for receiving said rod and accommodating pivotal movement of said face plate with respect to said defining means and limited rectilinear movement of said face plate with respect to said defining means.

15. The lock box as set forth in claim 14 including means for interlocking said face plate with said defining means to prevent pivotal movement of said face plate without previous rectilinear movement of said face plate with respect to said defining means.

16. The lock box as set forth in claim 15 wherein said interlocking means interlocks said face plate with said back plate.

17. The lock box as set forth in claim 15 including means for attaching the cam lock to said face plate and a retainer secured to said back plate for engagement by the latch of the cam lock to lock said face plate to said defining means.

18. The lock box as set forth in claim 15 including a staple extending from said face plate into the enclosure for receiving the shackle of the padlock and a retainer for locating and maintaining the body of the padlock in place with respect to said back plate, whereby upward movement of said face plate necessary to effect pivotal movement thereof is precluded by the interference of the shackle engaging said staple.

19. The lock box as set forth in claim 18 including means for repositioning said retainer to accommodate various sizes of padlock bodies.

20. The lock box as set forth in claim 18 including means for repositioning said staple to accommodate various sizes of shackles.

21. The lock box as set forth in claim 19 wherein said back plate includes an aperture for providing access by a key to the padlock.

22. The lock box as set forth in claim 15 wherein said channel, said back plate and said face plate are extrusions.

23. The lock box as set forth in claim 1 wherein said face plate includes a bracket for defining a housing adjacent said face plate and for supporting the lock means within the housing.

24. The lock box as set forth in claim 23 wherein said bracket supports the lock means to render the lock means accessible from a point external to said lock box.

25. The lock box as set forth in claim 23 including means for slidably detaching said bracket from said face plate when said face plate is in the open position.

* * * * *